US008205878B2

(12) United States Patent
Masuda

(10) Patent No.: US 8,205,878 B2
(45) Date of Patent: Jun. 26, 2012

(54) IMAGE FORMING APPARATUS CAPABLE OF PROVIDING SIDE REGISTRATION

(75) Inventor: Noritaka Masuda, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 1366 days.

(21) Appl. No.: 11/829,392

(22) Filed: Jul. 27, 2007

(65) Prior Publication Data

US 2008/0024808 A1 Jan. 31, 2008

(30) Foreign Application Priority Data

Jul. 27, 2006 (JP) ..... 2006-204797

(51) Int. Cl.
*B65H 9/16* (2006.01)

(52) U.S. Cl. ..... 271/249; 271/227; 271/228; 271/248; 271/250; 271/252

(58) Field of Classification Search ..... 271/227, 271/228, 248–252
See application file for complete search history.

(56) References Cited

U.S. PATENT DOCUMENTS

| | | | | |
|---|---|---|---|---|
| 5,322,012 | A * | 6/1994 | Gartner et al. | 101/232 |
| 5,335,904 | A * | 8/1994 | Ryuzaki | 271/272 |
| 5,794,176 | A * | 8/1998 | Milillo | 702/150 |
| 6,356,735 | B1 * | 3/2002 | Hozumi | 399/395 |
| 6,523,924 | B1 | 2/2003 | Adkins et al. | |
| 7,121,545 | B2 * | 10/2006 | Baumgarten et al. | 271/250 |
| 7,277,669 | B2 * | 10/2007 | Howe | 399/395 |
| 7,422,211 | B2 * | 9/2008 | Dejong et al. | 271/249 |
| 2004/0135835 | A1 | 7/2004 | Yun | |

FOREIGN PATENT DOCUMENTS

| | | |
|---|---|---|
| EP | 0 532 343 | 3/1993 |
| JP | 02-131966 | 5/1990 |
| JP | 02-198952 | 8/1990 |
| JP | 07-089645 | 4/1995 |
| JP | 08-211787 | 8/1996 |
| JP | 11-189355 | 7/1999 |
| JP | 2002-338089 | 11/2002 |
| JP | 2004-051256 | 2/2004 |
| JP | 2004-090284 | 3/2004 |

OTHER PUBLICATIONS

European Search Report.
Office Action mailed Jun. 21, 2011 for corresponding Japanese Patent Application No. 2006-204797.

* cited by examiner

*Primary Examiner* — Michael McCullough
*Assistant Examiner* — Luis A Gonzalez
(74) *Attorney, Agent, or Firm* — Harness, Dickey & Pierce, P.L.C.

(57) ABSTRACT

An image forming apparatus includes: a sheet conveyance path in which a sheet is conveyed; at least one sheet feeding mechanism to supply the sheet to the sheet conveyance path; a sheet conveyance mechanism to convey the sheet in a sheet conveyance direction; a detection mechanism to detect a position of a side of the sheet parallel to the sheet conveyance direction; a movement mechanism to move the sheet in a direction perpendicular to the sheet conveyance direction; a memory to store reference position information specific to the at least one sheet feeding mechanism, respectively; and a movement control mechanism to control a movement distance of the movement mechanism based on the detected position and the reference position information specific to a selected one of the at least one sheet feeding mechanism.

16 Claims, 7 Drawing Sheets

BACKGROUND

FIG. 4

| SHEET HOPPER # | SHEET SIZE | REFERENCE POSITION INFO. |
|---|---|---|
| 5 | A5LEF | a |
| | A5SEF | b |
| | A4LEF | c |
| | A4SEF | d |
| | A3SEF | e |
| | B5LEF | f |
| | . . . | . . . |
| 6 | A5LEF | g |
| | . . . | . . . |
| 7 | A5LEF | h |
| | . . . | . . . |
| 8 | A5LEF | i |
| | . . . | . . . |

IMAGE FORMING APPARATUS CAPABLE OF PROVIDING SIDE REGISTRATION

PRIORITY STATEMENT

This patent application claims priority under 35 U.S.C. §119 upon Japanese patent application, No. 2006-204797 filed in the Japan Patent Office on Jul. 27, 2006, the entire contents of which are incorporated by reference herein.

BACKGROUND

1. Field of Invention

Exemplary aspects of the present invention relate to an apparatus for image forming, and more particularly, to a multifunctional image forming apparatus having at least two functions amongst the following, a printer, a digital copier, and a facsimile.

2. Description of the Related Art

Image forming apparatus such as printers, digital copiers, facsimiles and multifunctional peripherals (capable of serving at least two of the following functions, printer, copier and facsimile), generally include a sheet feeding device, a sheet conveyance device and an image output unit. The sheet feeding device feeds a transfer sheet to a sheet conveyance path. The sheet conveyance device conveys the transfer sheet along the sheet conveyance path. The image output unit outputs an image on the transfer sheet. The sheet conveyance path of the sheet conveyance device includes a plurality of conveyance rollers thereon. The conveyance rollers are rotationally driven by drive sources such as motors to convey the transfer sheet.

Such image forming apparatuses can register the sheet position and image position in a direction (hereafter referred to as a side direction) perpendicular to a sheet conveyance direction. The sheet position in the side direction needs to be corrected at an upstream side from a position in which the image is output on the transfer sheet so that the image can be formed on an accurate position of the transfer sheet in the side direction. This correction of position is hereinafter referred to as a side registration adjustment, which will be described with reference to FIG. 1.

FIG. 1 illustrates an example of the related art side registration adjustment mechanism in a related art image forming apparatus.

The related art image forming apparatus includes a contact image sensor 210, a control unit 230, a shift unit 250, a pinion gear 280, a shift motor 290, and an eccentricity cam 300. The shift unit 250 includes a driving motor 320, a side plate 330, rotation axis 340, registration rollers 180, a spring 310, and a registration roller gear 270. As shown in FIG. 1, the rotation axis 340 is supported by a side plate (not shown) and the side plate 330 at respective ends thereof. The registration roller axis 340 includes the plurality of registration rollers 180 thereon and the registration roller gear 270 at a side of the side plate 330. The driving motor 320 is disposed on the side plate 330 to rotationally drive the pinion gear 280. The pinion gear 280 engages with the registration roller gear 270, and thereby, the registration rollers 180 are rotated through the rotation axis 340.

The side plate 330 is movably installed in the related art image forming apparatus so as to move in the side direction by a bias applied by the spring 310. For example, the spring 310 applies a bias towards an apparatus frame 260 (i.e., a direction XX2). The side plate 330 is held at a position where the side plate 330 contacts the eccentricity cam 300 that is rotated by the shift motor 290. Therefore, the side plate 330 moves in the directions XX1 and XX2 when the eccentricity cam 300 is rotated. The registration rollers 180 and the driving motor 320 also move in the directions XX1 and XX2 when the eccentricity cam 300 is rotated. The control unit 230 controls the driving of the driving motor 320 and the shift motor 290.

The registration rollers 180 register a transfer sheet 200 conveyed in a direction YY, indicated by an arrow in FIG. 1. For example, the pair of registration rollers 180 (a lower registration is not shown) sandwich the transfer sheet 200, and the contact image sensor 210 detects a position of one side of the transfer sheet 200 in the side direction. The transfer sheet 200 illustrated by a solid line in FIG. 1 achieves a shifted state in which one side of the transfer sheet 200 is shifted from a reference position SS illustrated by a dotted line. The reference position SS in the side direction represents a suitable position with respect to the image to be output thereon. When one side of the transfer sheet 200 is shifted from the reference position SS in the side direction as shown in FIG. 1, the shift unit 250 moves the transfer sheet 200 towards the direction XX1 with a movement thereof. After the transfer sheet 200 passes through the registration rollers 180, the shift unit 250 moves towards the direction XX2 so as to return to an initial position. The contact image sensor 210 detects an edge position of the transfer sheet 200 in the side direction so that the control unit 230 determines a movement distance Δ'X of the transfer sheet 200 in the direction XX1. Since the image is output assuming that the side edge of the transfer sheet 200 is located at the reference position SS, the side registration adjustment can be appropriately performed when the transfer sheet 200 is conveyed along the reference position SS in the side direction.

One example attempts to control the movement distance of a transfer sheet by using a memory mechanism. The movement distance of the transfer sheet determined by a shift unit and information on the transfer sheet such as thickness, quality and type are correlated and stored in the memory mechanism beforehand. Thereby, the movement distance of the transfer sheet is controlled based on the information stored in the memory mechanism.

However, when the transfer sheet is shifted in the side direction in a relatively large amount, the movement distance of the transfer sheet increases. In a successive printing operation, the shift unit moving to move the transfer sheet in the side direction has to return to an initial position before a next transfer sheet is conveyed thereto. In other words, when the movement distance is relatively large, the movement speed of the shift unit needs to be increased by using a high power motor. However, such a high power motor is costly.

In attempting to solve such a cost problem, a technique in that the side position of a transfer sheet is adjusted by adjusting the position of a sheet feeding unit is proposed. However, it is difficult to adjust the sheet feeding unit such as a sheet feeding cassette and a sheet hopper such that a side position of the transfer sheet matches with the reference position in the side direction.

SUMMARY OF THE INVENTION

An embodiment of the present invention provides an image forming apparatus that includes: a sheet conveyance path in which a sheet is conveyed; at least one sheet feeding mechanism to supply the sheet to the sheet conveyance path; a sheet conveyance mechanism to convey the sheet in a sheet conveyance direction; a detection mechanism to detect a position of a side of the sheet parallel to the sheet conveyance direction; a movement mechanism to move the sheet in a direction perpendicular to the sheet conveyance direction; a memory to store reference position information specific to the at least one sheet feeding mechanism, respectively; and a movement control mechanism to control a movement distance of the movement mechanism based on the detected position and the reference position information specific to a selected one of the at least one sheet feeding mechanism.

An embodiment of the present invention provides a method of controlling paper movement in such an image forming apparatus.

Additional features and advantages of the present invention will be more fully apparent from the following detailed description of example embodiments, the accompanying drawings and the associated claims.

BRIEF DESCRIPTION OF THE DRAWINGS

A more complete appreciation of the example aspects of the invention and many of the attendant advantage thereof will be readily obtained as the same becomes better understood by reference to the following detailed description when considered in connection with the accompanying drawings, wherein:

FIG. 4 is a schematic diagram illustrating (according to an example embodiment of the present invention) information on a reference position in a side direction stored in a nonvolatile memory in the image forming apparatus of FIG. 3;

DETAILED DESCRIPTION OF EXEMPLARY EMBODIMENTS

Figure 1:
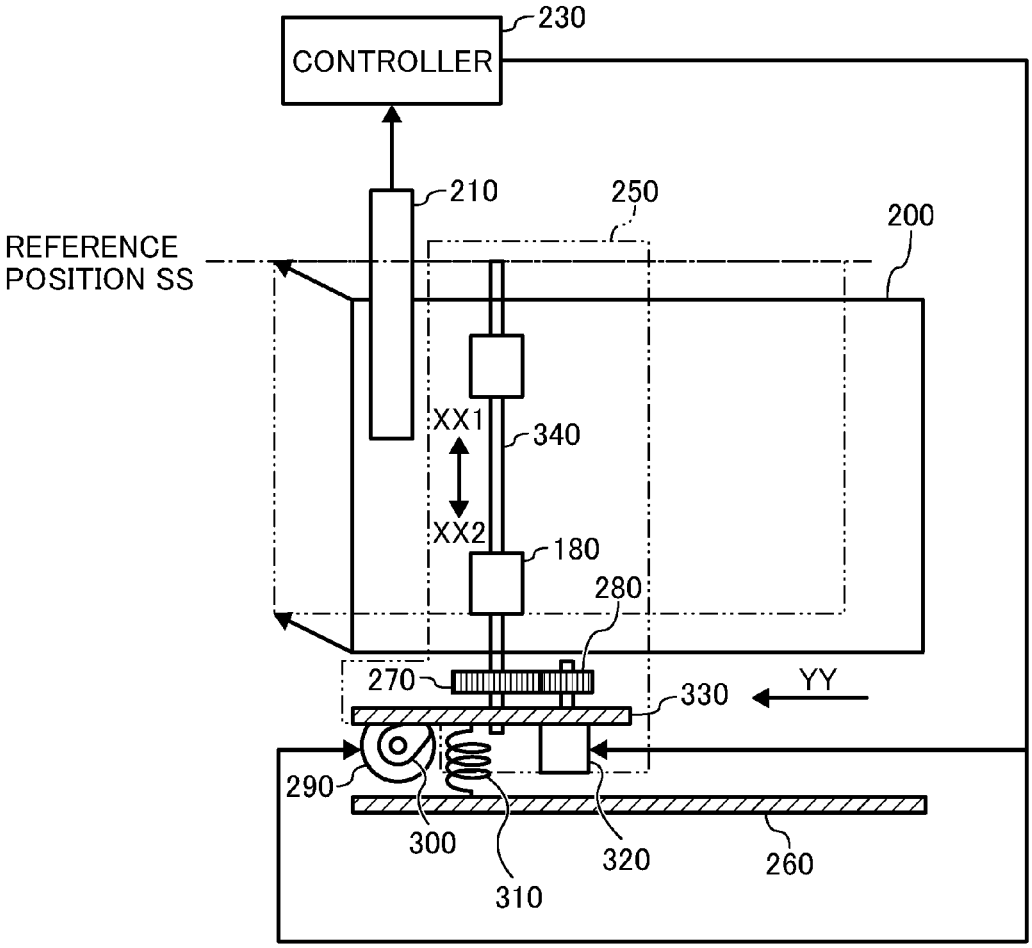
FIG. 1 is a block diagram illustrating an example of a related art side registration adjustment in a related art image forming apparatus.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, example embodiments of the present patent invention are described.

Figure 2:
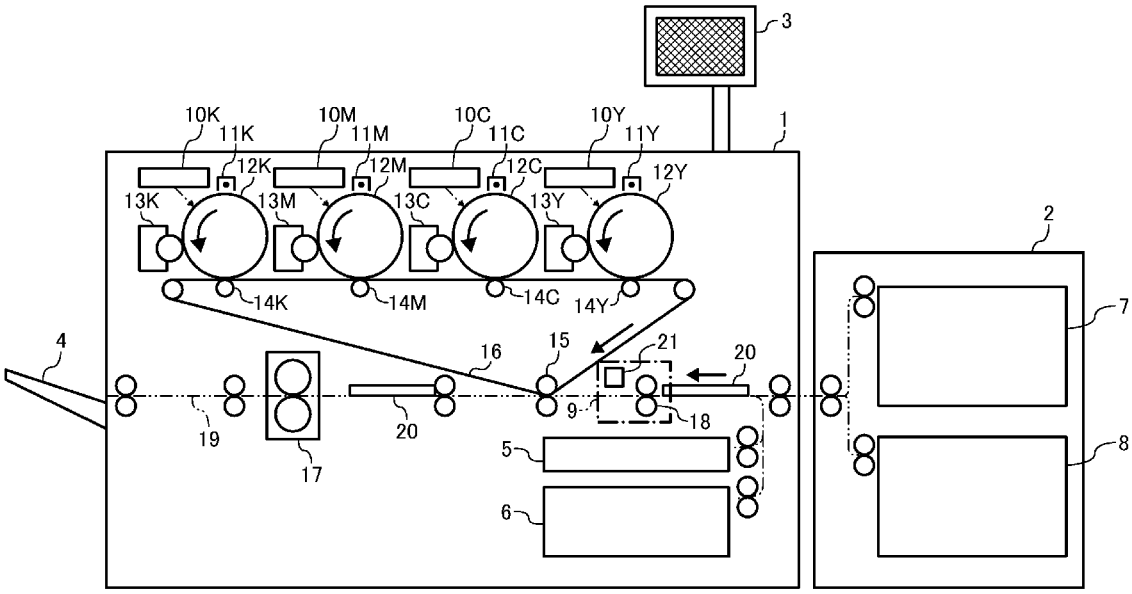
FIG. 2 is a schematic diagram illustrating a tandem laser printer as an image forming apparatus according to an example embodiment of the present invention.

Referring to FIG. 2, a tandem laser printer 1 as an image forming apparatus of an example embodiment of the present invention is illustrated.

The tandem laser printer 1 (also referred to as the image forming apparatus 1) includes an operation panel 3 (e.g., a touch screen, or a display device and an input terminal (not depicted)), an ejection tray 4, a first sheet hopper 5, a second sheet hopper 6, a correction mechanism 9, four laser scanning units 10, four charging devices 11, four photoconductor drums 12, four development devices 13, four primary transfer rollers 14, a secondary transfer roller 15, an intermediate transfer belt 16, a fixing unit 17, a pair of registration rollers 18, a sheet conveyance path 19, a transfer sheet 20 and a contact image sensor 21. The image forming apparatus 1 includes an additional sheet feeding unit 2 connected thereto.

The operation panel 3 is a panel used as an interface by which operation of the tandem laser printer 1 can be exchanged with a user who is physically proximal thereto. The ejection tray 4 is a tray on which the transfer sheet 20 is ejected. The first and second sheet hoppers 5 and 6 store the transfer sheets 20 therein. The correction mechanism 9 corrects a position of the transfer sheet 20.

The four laser scanning units 10 emit laser beams to expose surfaces of respective photoconductor drums 12. The four charging devices 11 uniformly charge respective photoconductor drums 12. The photoconductor drums 12 form electrostatic latent images thereon by the laser beams emitted from respective laser scanning units 10. The four development devices 13 develop the electrostatic latent images on respective photoconductor drums 12 to form the toner images. The four primary transfer rollers 14 primarily transfer the toner images on respective photoconductor drums 12 onto the intermediate transfer belt 16.

The secondary transfer roller 15 secondarily transfers the toner image on the intermediate transfer belt 16 onto the transfer sheet 20. The intermediate transfer belt 16 is an intermediate transfer member on which the toner image is transferred. The fixing unit 17 fixes the toner image on the transfer sheet 20. The pair of registration rollers 18 registers the transfer sheet 20 to convey in the sheet conveyance direction.

The sheet conveyance path 19 is a path in which the transfer sheet 20 is conveyed. The transfer sheet 20 is a sheet, for example, a sheet of paper and a sheet of resin film, on which the toner image is formed. The contact image sensor 21 detects a position of the transfer sheet 20 in a side direction.

Since the image forming apparatus 1 is the tandem laser printer, four image forming units for four toner colors (black, magenta, cyan, and yellow) are disposed. Each image forming unit includes a plurality of image forming elements. For example, the image forming unit for the black color includes the laser scanning unit 10K, the charging device 11K, the photoconductor drum 12K, the development device 13K, and the primary transfer roller 14K. As the four image forming units are substantially similar to one another except for the color of the toner, one of the image forming units is explained as representative of the four image forming units as necessary. The color abbreviations K, M, C and Y for black, magenta, cyan and yellow are omitted as necessary.

As illustrated in FIG. 2, the image forming apparatus 1 includes the intermediate transfer belt 16 in a middle portion thereof and the four photoconductor drums 12K, 12M, 12C, and 12Y in an upper portion thereof. Each of the photoconductor drums 12 includes the charging device 11, the development device 13, and the primary transfer roller 14 in the vicinity thereof.

Upon initiation of the printing operation, the photoconductor drum 12 is rotationally driven in a direction, indicated by an arrow shown in FIG. 2 while being charged by the charging device 11 with a suitable polarity. The laser scanning unit 10 emits a laser beam based on image data to scan the charged photoconductor drum 12 with the laser beam, thereby, forming an electrostatic latent image on the surface of the photoconductor drum 12. The development device 13 develops the electrostatic latent image on the photoconductor drum 12 to form the toner image. The primary transfer roller 14 transfers the toner image on the surface of the photoconductor drum 12 onto the intermediate transfer belt 16. The surface of the photoconductor drum 12 is cleaned by a photoconductor drum cleaner (not shown) to remove a residual toner thereon.

The four photoconductor drums 12K, 12M, 12C, and 12Y are used to form a color image. In a color image forming process, for example, toner images of black, magenta, cyan and yellow on the respective photoconductor drums 12 are transferred onto the intermediate transfer belt 16 while overlaid.

The image forming apparatus 1 includes the first sheet hopper 5 and the second sheet hopper 6 in a lower portion thereof and the additional sheet feeding unit 2 connected thereto. The additional sheet feeding unit 2 includes a third sheet hopper 7 and a fourth sheet hopper 8 storing the transfer sheet 20 therein. For example, a user uses the operation panel 3 and an input terminal (not shown) such as personal computers to select at least one of the sheet hoppers 5, 6, 7 and 8 so that the transfer sheet 20 is fed from the selected transfer hopper to the conveyance path 19.

The transfer sheet 20 is fed towards the registration rollers 18, and a leading edge thereof abuts on the registration rollers 18 being at a half. The registration rollers 18 register the transfer sheet 20 so as to feed towards a secondary transfer area including the secondary transfer roller 15 at a desired timing to the toner image on the intermediate transfer belt 16.

The secondary transfer roller 15 secondarily transfers the toner image on the intermediate transfer belt 16 onto the transfer sheet 20, and feeds the transfer sheet 20 towards the fixing device 17. The toner image on the transfer sheet 20 is fixed by the fixing device 17 and is ejected on the ejection tray 4. The surface of the intermediate transfer belt 16 is cleaned by a belt cleaner (not shown) to remove a residual toner thereon.

According to the image forming apparatus 1 of the example embodiment, the correction mechanism 9 is disposed at an upstream side in a sheet conveyance direction of the secondary transfer roller 15 so as to correct the position of the transfer sheet 20 in the side direction. This position correction of the transfer sheet 20 by the correction mechanism 9 can be referred as a side registration adjustment. The correction mechanism 9 will be explained below referring to the diagram of FIG. 3.

Figure 3:
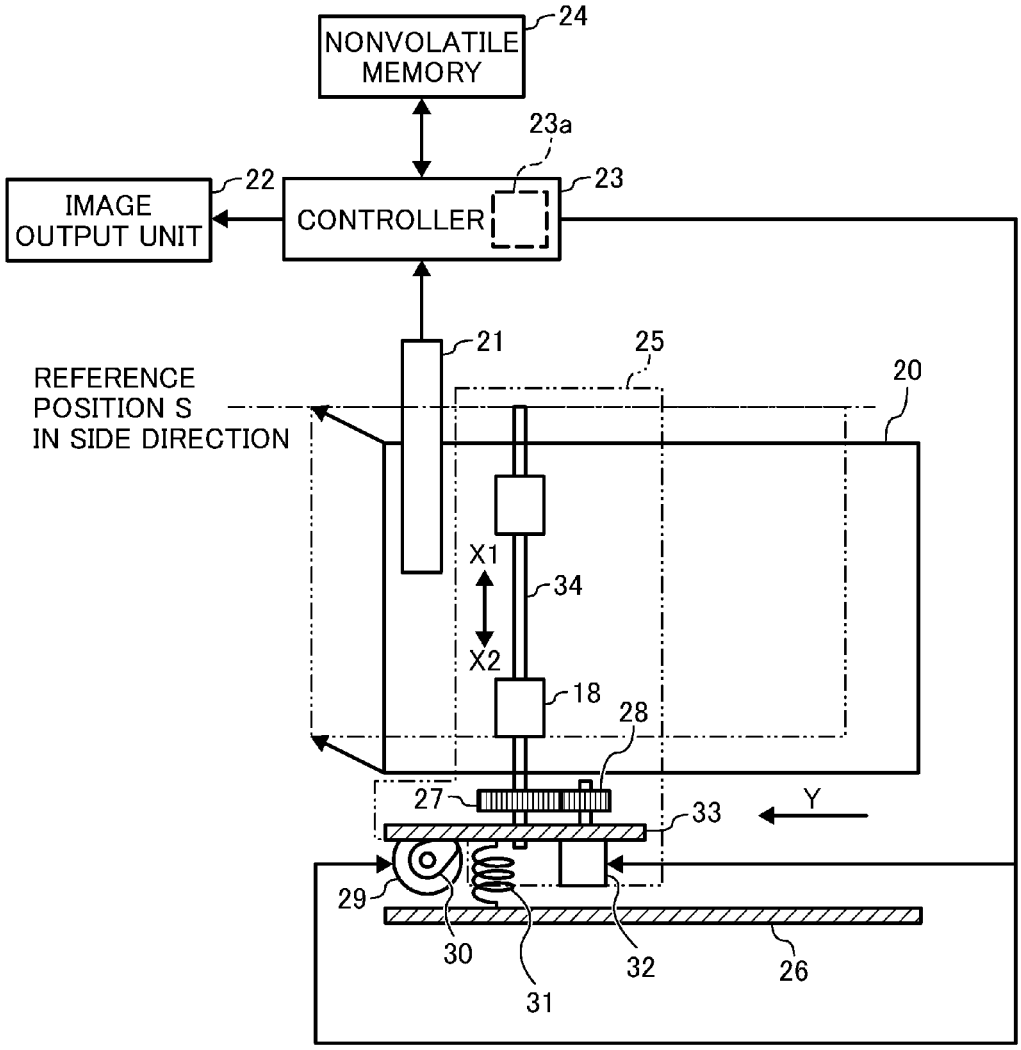
FIG. 3 is a block diagram (according to an example embodiment of the present invention) illustrating an example of a side registration adjustment in the image forming apparatus of FIG. 2.

FIG. 3 illustrates an example of the side registration adjustment provided by the correction mechanism 9. As shown in FIG. 3, the correction mechanism 9 is similar to the related art side registration adjustment of FIG. 1 except for a nonvolatile memory 24, an image output unit 22, and a control unit that includes a reference position calculation mechanism 23*a*. The correction mechanism 9 includes the contact image sensor 21, a shift unit 25, a pinion gear 28, a shift motor 29, an eccentricity cam 30, a driving motor 32, a side plate 33, a rotation axis 34, the registration rollers 18, a spring 31, a registration roller gear 27 and an apparatus frame 26. These elements are substantially similar to the contact image sensor 210, the shift unit 250, the pinion gear 280, the shift motor 290, the eccentricity cam 300, the driving motor 320, the side plate 330, the rotation axis 340, registration rollers 180, the spring 310, the registration roller gear 270 and the apparatus frame 260 of FIG. 1, respectively. Therefore, a description of each element will be omitted.

The transfer sheet 20 is conveyed from the upstream side of the sheet conveyance path 19 and is sandwiched between the pair of the registration rollers 18 so as to be conveyed in a direction Y by the driving force applied by the driving motor 32. When the transfer sheet 20 is positioned in a solid line in FIG. 3, the shift motor 29 moves the transfer sheet 20 towards a direction X1 to a reference position S illustrated by a dotted line in the side direction by the driving force thereof while the transfer sheet 20 remains sandwiched. After the transfer sheet 20 passes through the registration rollers 18, the shift unit 25 moves in a direction X2 to return to an initial position thereof. The contact image sensor 21 detects an edge position of the transfer sheet 20 in the side direction so that the control unit 23 determines a movement distance ΔX of the transfer sheet 20 towards the direction X1.

The transfer sheet 20 is preferably conveyed along the reference position S in the side direction. However, the transfer sheet 20 can be shifted from the reference position S due to various events such as mechanical inaccuracy of the sheet conveyance path 19, unbalanced diameter of a conveyance roller (not shown), a skid of the conveyance roller, and position inaccuracy of the sheet hoppers 5, 6, 7 and 8 in the side direction.

For example, when the transfer sheet 20 is shifted in the side direction from the reference position S caused by the position inaccuracy of one of the sheet hoppers 5, 6, 7 and 8, each transfer sheet 20 withdrawn from a given sheet hopper will be shifted by substantially the same amount. In other words, the shift of the transfer sheet 20 caused by the position inaccuracy of one of the sheet hoppers 5, 6, 7 and 8 in the side direction is unlikely to fluctuate in a short time period. Therefore, the reference position S in the side direction is determined beforehand with respect to each of the sheet hoppers 5, 6, 7 and 8, respectively, so that the movement distance ΔX can be reduced. The determination of the reference position S will be described later. The nonvolatile memory 24 stores reference position information used to determine the reference position S in the side direction. The reference position calculation mechanism 23*a* will be described with reference to FIG. 5.

Referring to FIG. 4, an example of the reference position information in the side direction stored in the nonvolatile memory 24 is illustrated. According to the example embodiment, the nonvolatile memory 24 individually stores the reference position information with respect to each sheet hopper and each sheet profile. An example of a sheet profile is information, e.g., a code, indicative of sheet size and/or sheet orientation, e.g., A4LEF, where A4 denotes a standard size, and LEF denotes sheet orientation, LEF being an acronym for long-edge-fed (as contrasted with SEF (short-edge-feed)).

The determination of the reference position S in the side direction is now explained by using an example situation as follows. An operator uses the operation panel 3 to execute a reference position setting mode when the image forming apparatus 1 is shipped from a factory and is connected to the additional sheet feeding unit 2. The reference position setting mode for the side direction will be described later with respect to the flowchart of FIG. 5.

The operator activates the reference position setting mode for the side direction from the operation panel 3 and follows an instruction displayed on the operation panel 3 to load a specified size of the transfer sheet 20 into at least one of the sheet hoppers 5, 6, 7 and 8 to be selected (where, e.g., sheet orientation is automatically determined once the sheet 20 has been loaded into the given hopper). The operator manipulates the operation panel 3 to start the setting mode when the transfer sheet 20 is loaded. The reference position calculation mechanism 23*a* of the control unit 23 automatically executes subsequent processes of the setting mode which will be described below referring to the flowchart of FIG. 5.

Figure 5:
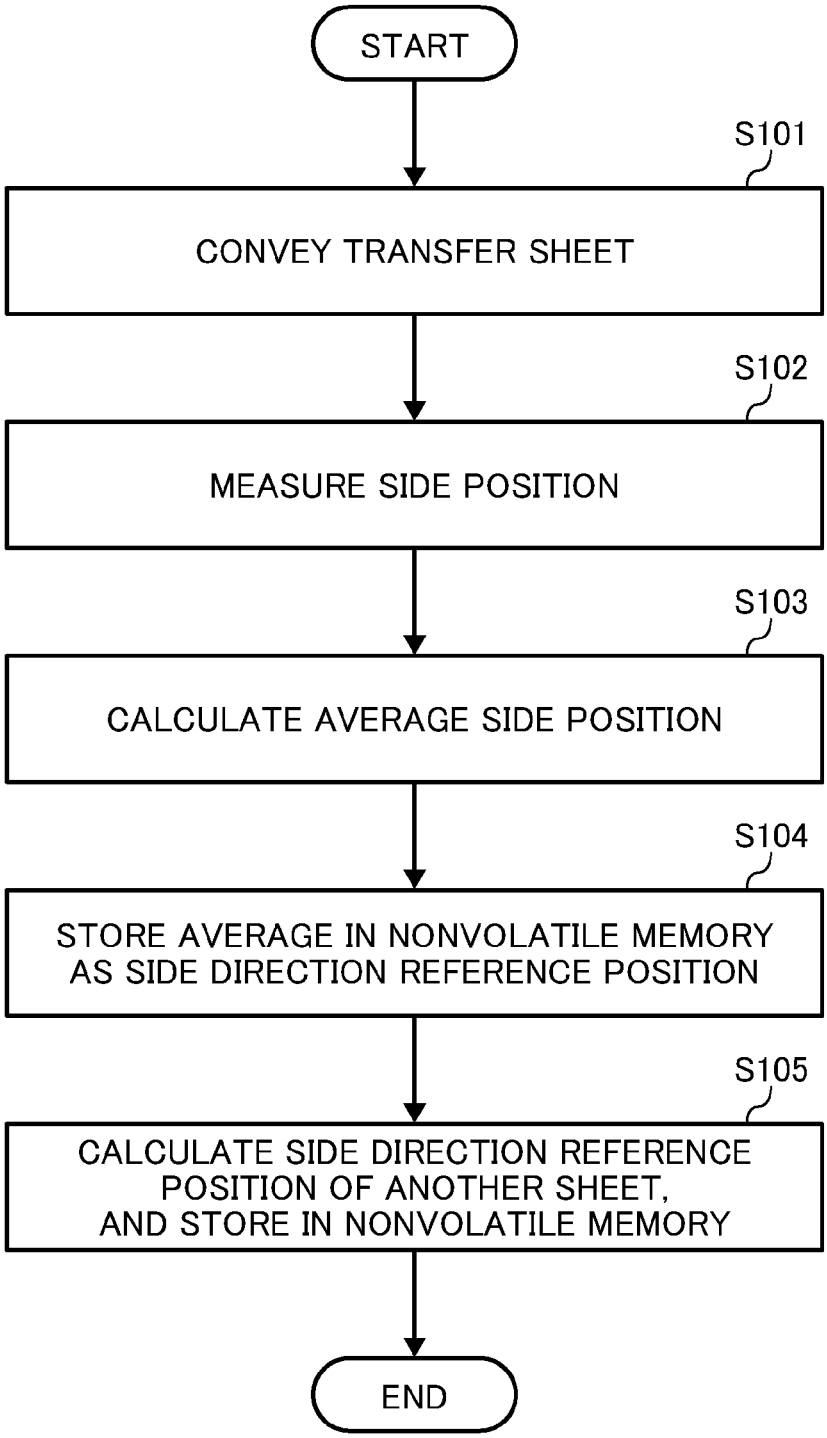
FIG. 5 is a flowchart illustrating an example procedure (according to an example embodiment of the present invention) for determining the reference position in the side direction by a reference position setting mode.

According to the example procedure of FIG. 5, the specified size and specified number of the transfer sheet 20 is fed from the selected sheet hopper at a constant interval, and is conveyed to the sheet conveyance path 19 as similar to the normal printing operation (Step S101). The specified number can be more than one. When each of the specified number of the transfer sheet 20 reaches the contact image sensor 21, a side position thereof is measured by the contact image sensor 21 (Step S102). The reference position calculation mechanism 23*a* calculates an average value based on the side positions measured by the contact image sensor 21 (Step S103). The nonvolatile memory 24 stores the average value as the reference position S in the side direction of the specified transfer sheet 20 (Step S104). The calculated average value can be a position in which a side edge of the transfer sheet 20 passes. Therefore, the reference position setting mode for the side direction ends, and the operation panel 3 displays an end message to the operator. According to the example embodiment, the setting mode is executed by feeding the transfer sheet 20 without outputting the image.

Therefore, the reference position S in the side direction for one of the sheet profiles, for example, A4LEF (A4 size, long-edge-feed orientation) in the first sheet hopper 5 can be determined. The reference position S for other sheet profiles such as A5LEF, A5SEF (short-edge-feed orientation) and A3LEF in the first sheet hopper 5 can be determined by a similar manner; however, it can consume time.

The A4LEF sheet profile in the sheet hopper 5, for example, can be used as a reference outer dimension to calculate the reference positions S for other sheet profiles such as A5LEF, A5SEF and A3LEF in the sheet hopper 5 based on outer dimension differences, thereby reducing the determination time. The nonvolatile memory 24 stores, for example, the reference position information in the side direction as shown in FIG. 4 (Step S105).

Therefore, each reference position S in the side direction for each profile of the transfer sheet 20 in the first, second, third and fourth sheet hoppers 5, 6, 7 and 8 is determined. In other words, the reference position S in the side direction is arranged with respect to each sheet profile in the first, second, third and fourth sheet hoppers 5, 6, 7 and 8 in the example embodiment. The determined reference position S in the side direction can fluctuate over time with variation in the sheet conveyance line due to abrasion of the conveyance roller, position shift of the sheet hopper and so forth. Thereby, the reference position S in the side direction can be updated in the course of the normal printing operation by calculating the average side position of the transfer sheet 20 prior to the side registration adjustment. The reference position S can also be updated when opening and closing the first, second, third and fourth sheet hoppers 5, 6, 7 and 8 to supply the transfer sheet 20.

Figure 6:
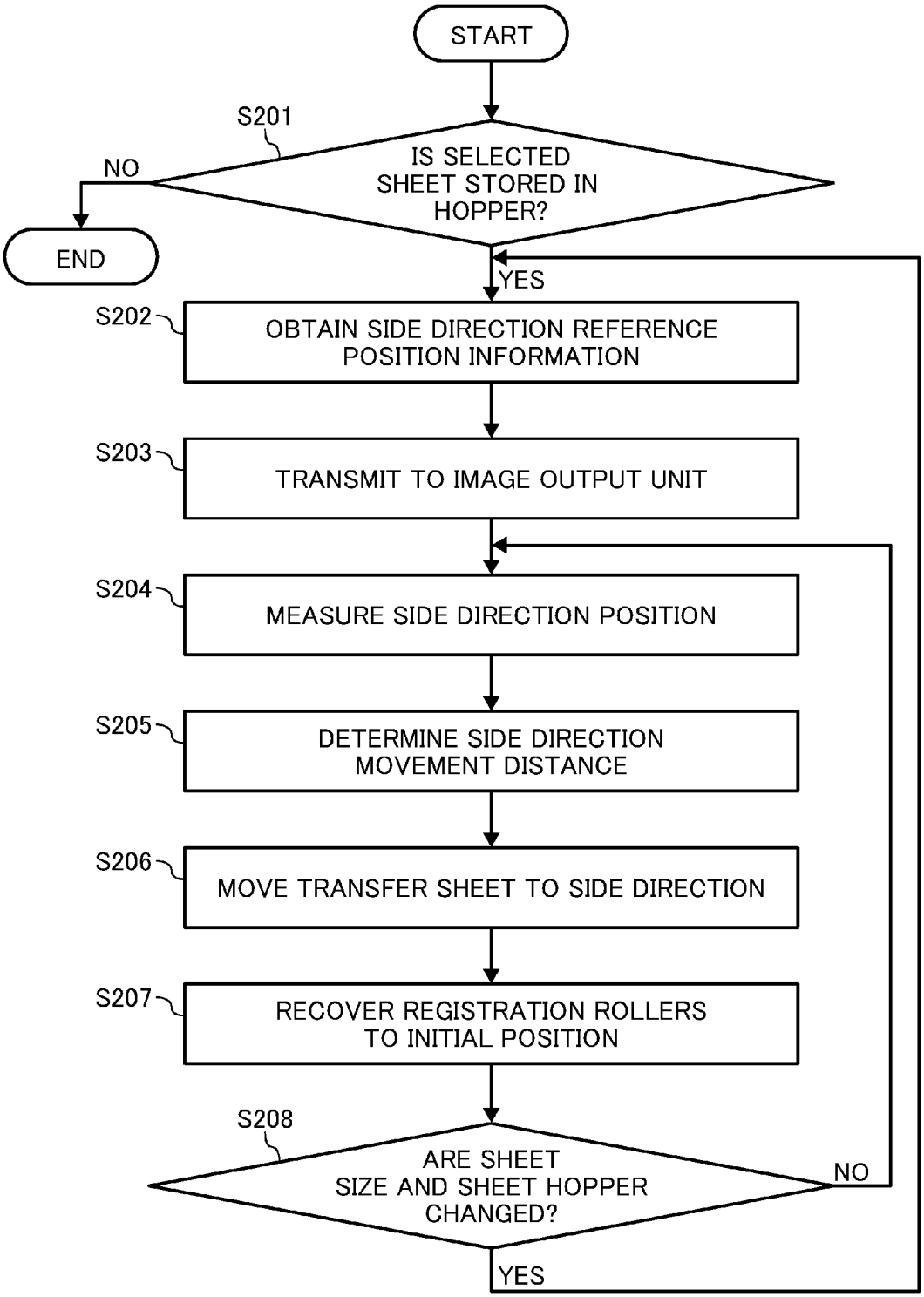
FIG. 6 is a flowchart illustrating an example procedure (according to an example embodiment of the present invention) for correcting the side registration.

Referring to FIG. 6, the flowchart illustrates an example procedure for correcting the side registration based on the determined reference position S in the side direction.

According to the example procedure of FIG. 6, when the user selects the A4LEF size transfer sheet 20 stored in the first sheet hopper 5 by using the input terminal (not shown), the first sheet hopper 5 is checked whether the selected size transfer sheet 20 is stored (Step S201). When the selected size transfer sheet 20 is not stored in the sheet hopper 5 (No in Step S201), flow ends. When the selected size transfer sheet 20 is stored in the first sheet hopper 5, (Yes in Step S201), flow proceeds to step S202 (Yes in Step S201).

At step S202, the control unit 23 reads the reference position information "c" of FIG. 4 from the nonvolatile memory 24 as the reference position S in the side direction (Step S202). The control unit 23 transmits image position information to the image output unit 22 based on the reference position information "c" (Step S203). The specified number of the transfer sheet 20 is fed from the first sheet hopper 5 and is conveyed to the sheet conveyance path 19 at the constant interval.

When each transfer sheet 20 reaches the contact image sensor 21, the side direction position thereof is measured (Step S204). The movement distance (also referred to as a correction amount) of the registration rollers 18 is determined based on the side direction position and the reference position S in the side direction of the transfer sheet 20 (Step S205). Upon reaching the registration rollers 18, the transfer sheet 20 is sandwiched by the registration rollers 18 so as to be moved to the reference position S in the side direction based on the position information "c" (Step S206).

As the side edge of the transfer sheet 20, for example, the A4LEF sheet profile in the first sheet hopper 5, is conveyed along the reference position S determined beforehand, the movement distance in the side direction can be zero or relatively small. Therefore, the shift unit 25 can reduce a movement force thereof, and the side registration can be corrected without using a high torque motor for the shift motor 29.

The registration rollers 18 are returned to the initial position thereof when the transfer sheet 20 has passed therebetween (Step S207). The movement distance of the registration rollers 18 returning to the initial position is relatively small in the example embodiment, thereby applicable to a high speed sheet feeding printer. When the sheet profile and the sheet hopper are not changed (No in Step S208), flow proceeds back to step S204. When the sheet profile and the sheet hopper are changed (Yes in Step S208), flow proceeds back to step S202.

In the example embodiment, the reference position S in the side direction is arranged with respect to each sheet profile of the transfer sheet 20 in the sheet hopper. Thereby, the shift unit 25 can move easily in the course of the side registration adjustment, and can be mechanically simplified.

This state in which the reference position S is arranged with respect to each sheet profile controls a writing position in the image output unit 22. In other words, the writing position is controlled with respect to each arranged reference position S.

Figure 7:
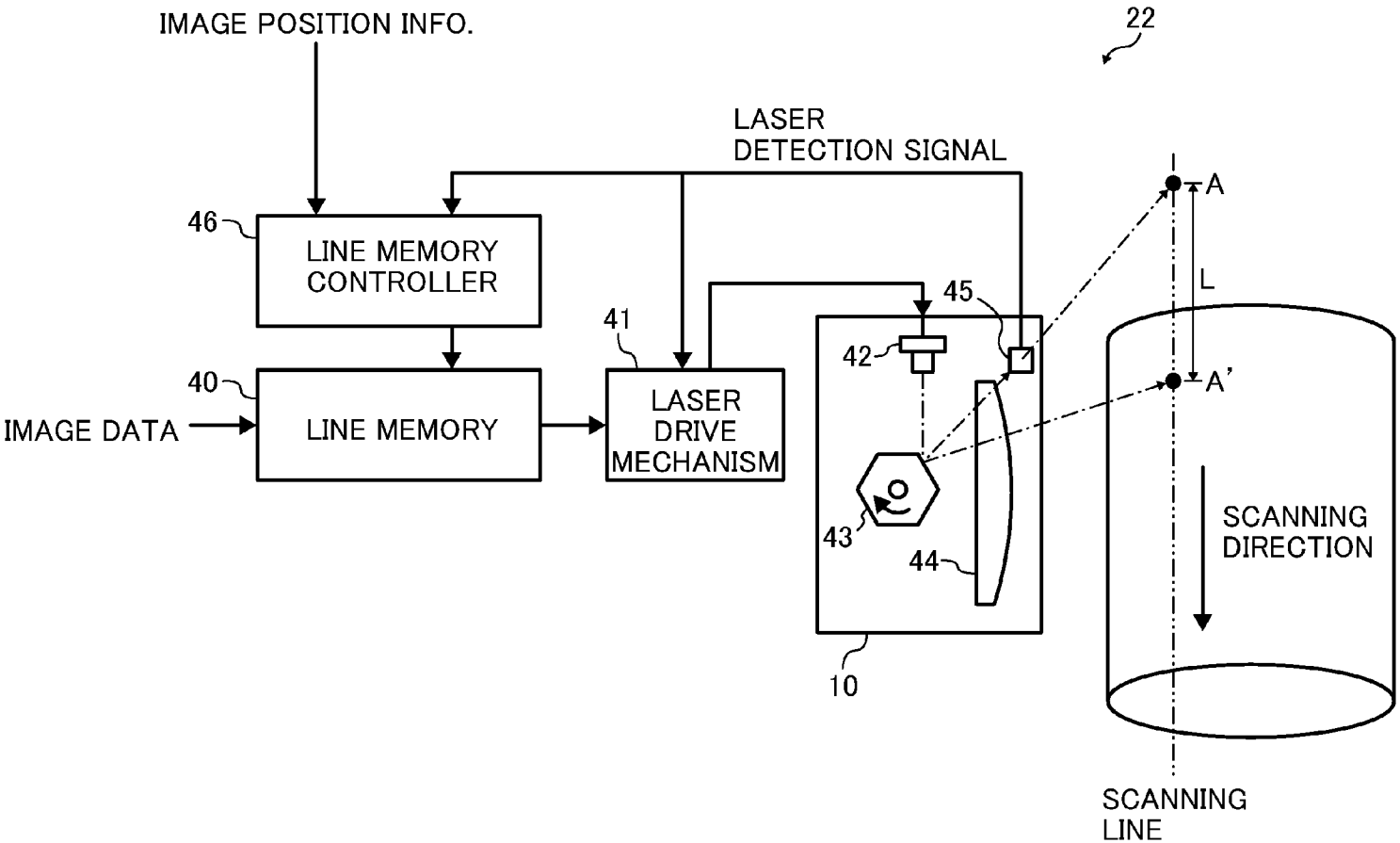
FIG. 7 is a schematic diagram illustrating an output unit (according to an example embodiment of the present invention) in the image forming apparatus of FIG. 3.

Referring to FIG. 7, the output unit 22 for one toner color is schematically illustrated as representative for four toner colors.

The output unit 22 includes a line memory 40, a laser drive mechanism 41, a laser diode 42, a polygon mirror 43, a Fθ lens 44, a laser detection mechanism 45 and a line memory controller 46.

The line memory 40 temporarily stores the image data transmitted from an upper-level device (not shown). The line memory controller 46 controls the reading and writing of the image data from and to the line memory 40. The laser drive mechanism 41 drives the laser diode 42 to emit the laser beam based on the image data transmitted from the line memory 40. A driving mechanism (not shown) rotates the polygon mirror 43 at a constant speed. The polygon mirror 43 reflects the laser beam emitted from the laser diode 42 so that the reflected laser beam passes through the Fθ lens 44. Subsequently, the leaser beam scans the surface of the photoconductor drum 12 at a constant speed, thereby forming the electrostatic latent image on the photoconductor drum 12. The laser drive mechanism 41 emits the laser beam immediately before a direction of the laser beam passes the laser detection mechanism 45, thereby performing a laser detection.

Upon receiving the laser beam, the laser detection mechanism 45 transmits a laser detection signal to the laser drive mechanism 41 and the line memory controller 46. The laser drive mechanism 41 determines a next timing of the laser detection based on the laser detection signal as a reference, thereby executing the laser detection for every scanning. The line memory controller 46 determines a timing at which the image data is read from the line memory 40 with respect to the image position information received from the control unit 23 based on the laser detection signal as the reference.

The image position information can be considered as a distance L between a position A and a position A' in FIG. 7. The position A represents a position of the laser detection mechanism 45 projected on the photoconductor drum 12, while the position A' represents an image writing position on the photoconductor drum 12. Therefore, the image writing position A' and reference position in the side direction (e.g., the side edge of the transfer sheet 20) are matched at an image transfer position in which the image is transferred on the transfer sheet 20.

Since the image writing position A' can be matched with the position information of the control unit 23, the reference position S in the side direction can be arranged with respect to each sheet profile in the selected sheet hopper.

In the example embodiment, the first, second, third, and fourth sheet hoppers 5, 6, 7 and 8 are used. However, a sheet cassette, for example, can be used as a sheet feeding mechanism. The Shift unit 25 is disposed in the vicinity of the registration rollers 18. However, the shift unit 25 can be disposed in an optional position as long as the shift unit 25 is positioned at an upstream side of the image output unit 22 on the sheet conveyance path 19.

Numerous additional modifications and variations are possible in light of the above teachings. It is therefore to be understood that, within the scope of the appended claims, the disclosure of this patent specification may be practiced otherwise than as specifically described herein.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program and computer program product. For example, the aforementioned methods may be embodied in the form of a system or device, including, but not limited to, any of the structure for performing the methodology illustrated in the drawings.

Even further, any of the aforementioned methods may be embodied in the form of a program. The program may be stored on a computer readable medium and is adapted to perform any one of the aforementioned methods when run on a computer device (a device including a processor). Thus, the storage medium or computer readable medium is adapted to store information and is adapted to interact with a data processing facility or computer device to perform the method of any of the above mentioned embodiments.

The storage medium may be a built-in medium installed inside a computer device main body or a removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media such as CD-ROMs and DVDs; magneto-optical storage media, such as MOs; magnetic storage media, including but not limited to floppy disks (trademark), cassette tapes, and removable hard disks; media with a built-in rewriteable non-volatile memory, including but not limited to memory cards; and media with a built-in ROM, including but not limited to ROM cassettes, etc. Furthermore, various information regarding stored images, for example, property information, may be stored in any other form, or provided in other ways.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An image forming apparatus comprising:

a sheet conveyance path in which a sheet is conveyed;

at least one sheet feeding mechanism to supply the sheet to the sheet conveyance path;

a sheet conveyance mechanism to convey the sheet in a sheet conveyance direction;

a detection mechanism to detect a position of a side of the sheet parallel to the sheet conveyance direction;

a movement mechanism to move the sheet in a direction perpendicular to the sheet conveyance direction towards a reference position;

a memory to store reference position information specific to the at least one sheet feeding mechanism, respectively;

a movement control mechanism to control a movement distance of the movement mechanism based on the detected position and the reference position information specific to a selected one of the at least one sheet feeding mechanism; and a reference position calculator mechanism to calculate the reference position based on the detected position, wherein a result calculated by the reference position calculator mechanism is stored in the memory as the reference position information.

2. The image forming apparatus of claim 1, further comprising:

an image output mechanism to output an image on the sheet, the image output mechanism determining a position of the output image in the direction perpendicular to the sheet conveyance direction based on the reference position information.

3. The image forming apparatus of claim 2, wherein the at least one sheet feeding mechanism includes a plurality of sheet feeding mechanisms, wherein the memory stores the reference position information with respect to each combination of one of the plurality of sheet feeding mechanisms to be selected and a size of the sheet to be fed from the selected sheet feeding mechanism, and wherein the image output mechanism determines the position of the output image in the direction perpendicular to the sheet conveyance direction based on the reference position information of the selected sheet feeding mechanism.

4. The image forming apparatus of claim 2, wherein the sheet conveyance mechanism conveys the sheet while the image output mechanism does not output an image thereon and the reference position calculator mechanism calculates the reference position.

5. The image forming apparatus of claim 2, wherein:

the detection mechanism performs detection on a plurality of sheets; and the reference position calculator mechanism determines the reference position information based upon an average of the detected positions corresponding to the plurality of sheets.

6. The image forming apparatus of claim 2, wherein:

the reference position calculated by the reference position calculator mechanism is a first reference position;

the memory stores at least first and second sheet profiles;

the memory associates the first reference position with the first sheet profile;

the reference position calculator mechanism also determines a reference position for a second sheet profile based upon the reference position associated with the first sheet profile;

the memory stores the second reference position; and the memory associates the second reference position with the second sheet profile.

7. The image forming apparatus of claim 1, further comprising:

a manual input mechanism by which an operator can access the reference position information stored in the memory.

8. The image forming apparatus of claim 1, wherein the at least one sheet feeding mechanism includes a plurality of sheet feeding mechanisms, wherein the memory stores the reference position information with respect to each combination of one of the plurality of sheet feeding mechanisms to be selected and a size of the sheet to be fed from the selected sheet feeding mechanism, and wherein the movement control mechanism determines the movement distance based on the detection result of the detected position and the reference position information of the selected sheet feeding mechanism.

9. The image forming apparatus of claim 1, wherein:

the detection mechanism performs detection on a plurality of sheets; and the reference position calculator mechanism determines the reference position information based upon an average of the detected positions corresponding to the plurality of sheets.

10. The image forming apparatus of claim 9, wherein the reference position calculator mechanism calculates a reference position of a second sheet based on the sheet profile detected by the detection mechanism, and the memory stores the reference position of the second sheet.

11. A method of controlling paper movement in an image forming apparatus, there being therein a sheet conveyance path along which a sheet is conveyed in a sheet conveyance direction, the image forming apparatus including at least one sheet feeding mechanism to supply the sheet to the sheet conveyance path and a sheet conveyance mechanism to convey the sheet in the sheet conveyance direction, the method comprising:

detecting, by a detection mechanism, a position of a side of the sheet parallel to the sheet conveyance direction;

moving the sheet, by a movement mechanism, towards a reference position in a direction perpendicular to the sheet conveyance direction based on the detected position and reference position information specific to a selected one of the at least one sheet feeding mechanism, respectively;

calculating, by a calculator mechanism, the reference position based on the detected position; and storing a result of the calculation in a memory as the reference position information.

12. The method of claim 11, further comprising:

determining a position in the direction perpendicular to the sheet conveyance direction of an output image on the sheet based on the reference position information.

13. The method of claim 11, wherein:

detecting the positions of sides of a plurality of sheets, respectively; and determining the reference position information based upon an average of the detected positions corresponding to the plurality of sheets.

14. The method of claim 12, further comprising:

selecting a sheet feeding mechanism from the at least one sheet feeding mechanisms;

detecting configuration characteristics of the selected sheet feeding mechanism;

determining a sheet profile of sheets contained in the selected sheet feeding mechanism based upon the detected characteristics; and calculating a reference position of a second sheet based on the determined sheet profile.

15. The method of claim 11, wherein the at least one sheet feeding mechanism includes a plurality of sheet feeding mechanisms, the method further comprising:

storing, in the memory, reference position information with respect to each combination of one of the plurality of sheet feeding mechanisms to be selected and a size of the sheet to be fed from the selected sheet feeding mechanism; and determining a movement distance for moving the sheet toward the reference position movement distance based on the detected size and the reference position information of the selected sheet feeding mechanism.

16. The method of claim 11, further comprising:

detecting positions of sides of a plurality of sheets, respectively;

calculating an average of the detected positions corresponding to the plurality of sheets; and determining the reference position information based upon the average of the detected positions.

* * * * *